US006343849B1

(12) United States Patent
Yun et al.

(10) Patent No.: US 6,343,849 B1
(45) Date of Patent: Feb. 5, 2002

(54) MICROACTUATOR FOR INK JET PRINTER HEAD USING A SHAPE MEMORY ALLOY AND MANUFACTURING METHOD THEREOF

(75) Inventors: Sang Kyeong Yun; Sung June Park, both of Suwon-Shi; Myung Song Jung, Kunpo-Shi, all of (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/442,513

(22) Filed: Nov. 18, 1999

(30) Foreign Application Priority Data

Jul. 6, 1999 (KR) ..... 99-27078

(51) Int. Cl.[7] ..... B41J 2/04
(52) U.S. Cl. ..... 347/20; 347/54
(58) Field of Search ..... 347/20, 47, 54, 347/56, 70, 71; 216/27

(56) References Cited

U.S. PATENT DOCUMENTS 6,130,689 A * 10/2000 Choi ..... 347/54
6,258,284 B1 * 7/2001 Silverbrook ..... 216/27

* cited by examiner

*Primary Examiner*—Anh T. N. Vo
(74) *Attorney, Agent, or Firm*—Darby & Darby

(57) ABSTRACT

The present invention relates a manufacturing method of a microactuator for an ink jet printer head using a shape memory alloy, the method comprising steps of: providing a silicon substrate; forming an insulating film on the surface of the silicon substrate; forming a shape memory alloy layer by independent repetitive molding of each layer of respective component element constituting the shape memory alloy on the insulation film; bestowing a shape memory property by thermally treating the shape memory alloy layer; and forming a lower space part by etching the silicon substrate, and a microactuator manufactured by the method, whereby it is easy to control the composition constituting the shape memory alloy layer so that shape memory property of shape memory alloy layer is enhanced; and also it makes effect that it is eminent in repetition uniformity of ingredient composition ratios compared to traditional methods in which simultaneous vapor deposition or sputtering of all formation components is carried out because now each component element thickness and film growth sequence are independently controlled.

25 Claims, 2 Drawing Sheets

MICROACTUATOR FOR INK JET PRINTER HEAD USING A SHAPE MEMORY ALLOY AND MANUFACTURING METHOD THEREOF

BACKGROUND OF THE INVENTION

1. Field of the Invention

The present invention relates to a microactuator for ink jet printer head and a manufacturing method thereof. In particular, the invention relates to a manufacturing method of a microactuator for ink jet printer head using a shape memory alloy and the microactuator manufactured by the method.

2. Description of the Prior Art

Generally microactuator for ink jet printer head using a shape memory alloy is composed of a silicon substrate 10 where lower space is formed, an insulation film 12 made to cover the lower space part upon the silicon substrate 10, and a shape memory alloy layer 14 formed upon insulation film 12 as in FIG. 1.

A shape memory alloy layer has been formed by multi-coating by simultaneous sputtering or evaporation etc. of metal components which are to form the shape memory alloy layer in order to manufacture a microactuator for ink jet printer head using a shape memory alloy.

Shape memory property is bestowed to shape memory alloy layer by repeated shape memory process to thermally treat the formed shape memory alloy layer by heating in furnace or heating by supplying an electric current and then to cool it.

Such heat treatment process is varied according to shape memory alloy components and their composition; and rearrangement degree of components comprising the shape memory alloy is varied according to heat treatment method and stage.

Shape memory alloy components get to have shape memory property by repeated rearrangement process in shape memory process and the acquired property is expressed outside.

Shape memory alloy layer is formed in conventional methods by sputtering or evaporation by multitarget method or using target made of alloy from components to form the shape memory alloy.

But the above methods have problem that those cannot be applied to form a shape memory alloy with 3-component system while those may be applied to form a shape memory alloy with a 2-component system.

And there is problem that composition is not uniform for a whole because composition ratios of components are different in minute parts although the above methods may be applied in 2-component systems.

Because component composition ratios of each part are not uniform, there is problem that we cannot get uniform shape memory effect from heat treatment process sensitive to shape memory alloy components and composition ratios of shape memory alloy components.

SUMMARY OF THE INVENTION

The present invention to solve the above problem aims to provide a microactuator for ink jet printer head using a shape memory alloy excellent in shape memory effect as composition of each part is uniform for a whole by way of repeated step of independently forming each formation component of shape memory alloy and a manufacturing method thereof.

The present invention to achieve the above purpose features a manufacturing method of a microactuator for ink jet printer head using a shape memory alloy, the method comprising steps of: providing a silicon substrate; forming an insulating film on the surface of the silicon substrate; forming a shape memory alloy layer by independent repetitive molding of each layer of respective component element constituting the shape memory alloy on the insulation film; bestowing a shape memory property by thermally treating the shape memory alloy layer; and forming a lower space part by etching the silicon substrate, whereby it is easy in control of components constituting the shape memory alloy layer and excellent in repetition uniformity of ingredient composition ratios.

And the present invention features a microactuator for ink jet printer head using a shape memory alloy, the microactuator comprising: a silicon substrate; a lower space part formed by etching at the silicon substrate; an insulating film formed on the silicon substrate surface to cover the lower space part which film applies compressive stress to the silicon substrate and undergoes bending transformation by the compressive stress of the silicon substrate which stress is expressed by the lower space part; and a shape memory alloy layer formed upon the insulation film so as to cover the lower space part which alloy layer is formed by independent sequential cumulative repetition of layering of each layer of respective composition element constituting the shape memory alloy and is bestowed shape memory property by heat treatment, whereby it is easy in control of components constituting the shape memory alloy layer and excellent in repetition uniformity of ingredient composition ratios.

DETAILED DESCRIPTION

Figure 1:
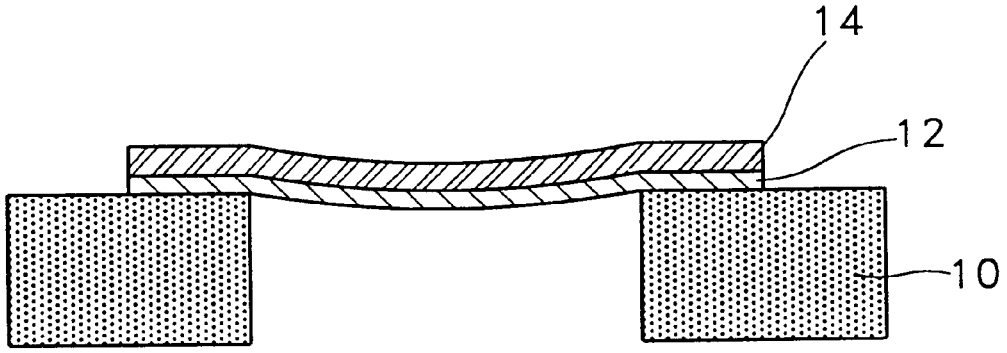
FIG. 1 is cross section view showing the general structure of microactuator for ink jet printer head using a shape memory alloy.

The invention is explained in detail as follows.

Silicon substrate plate is used as for the substrate.

Compressive stress is applied at silicon substrate ater forming the insulating film(s) of silicon oxide film ($SiO_2$), silicon nitride film (SiNx) or silicon oxide film/nitride film on one or both surfaces of silicon substrate.

Whence it is preferable to form the insulating film 1–3 $\mu$m thick.

Methods such as silicon substrate heat treatment including thermal oxidation of silicon substrate, chemical vapor deposition, sputtering, and spray are used as for forming method of silicon oxide film or silicon nitride film.

Insulation film of adequate component shall be formed according to needed internal stress magniture because the oxidized silicon film acts to push the shape memory alloy film to direction of nozzle while the nitrified silicon film acts to pull the shape memory alloy film to the opposite side.

Shape memory alloy layer is formed on insulation film formed.

It is preferable to use 2- or 3-component system for shape memory alloy layer components.

It is preferable to use nickel and titanium for shape memory alloy components if the alloy layer is to be formed of 2-component system.

It is preferable to use nickel, titanium and copper or nickel, titanium and hafnium for shape memory alloy components if the alloy layer is to be formed of 3-component system.

Shape memory alloy layer is formed by repeating the step to independently form each film of component element constituting the shape memory alloy on insulation film top.

Evaporation or sputtering is used as for the method to form the film.

Because reactivity in heat treatment process after total forming of shape memory alloy layer is lowered if each component element film formed at one time is thick, it is preferable that each film layer formed at one time is thick below 1,000 Å and more preferably below 500 Å.

Because reponse to signal is slow if shape memory alloy layer is thick, shape memory alloy layer shall be formed to thin film and so it is preferable that the total shape memory alloy layer formed after repetitive film forming is 1–3 $\mu$m thick.

Components of shape memory alloy layer to be formed can be controlled by controlling the method of forming each composition element layer.

By repetition of thermally treating and cooling process of the independently multitreated shape memory alloy layer, formation components and thermal elastic transformation characteristics are controlled to donate shape memory property to the shape memory alloy layer.

Bestowed shape memory property depends on heat treatment temperature, heat treatment duration, heat treatment method, cooling time and process repetition degree.

Shape memory alloy bestowed of shape memory property may be patterned to a specified pattern as needed.

To pattern the shape memory alloy, use is made of method to pattern it by etching after masking using a shadow mask or a photoresist.

The insulating film formed below shape memory alloy may be patterned as needed after patterning the shape memory alloy into wanted pattern.

How to pattern the insulating film is same as how to pattern the shape memory alloy.

Electrode is formed into wanted pattern if needed on substrate where shape memory alloy and insulation film have been formed. Whence electrode is generally made of selected material from aluminum, gold, platinum and silver.

After the above processes finished, lower space part is formed by etching whole silicon substrate after pattern is formed on silicon substrate.

Dry etching and wet etching may be used alike while it is preferable to use dry etching method if to miniaturize whole structure of ink jet printer head applying a microactuator using a shape memory alloy.

Whence insulation film formed on silicon substrate surface takes function of etching discontinuity layer.

If space is formed at lower part by etching the silicon substrate where shape memory alloy is formed, insulation film bends by internal stress of silicon substrate whereby shape memory alloy layer also goes bending transformation in which state it remains as deformed.

A microactuator using a shape memory alloy manufactured by the method, the microactuator comprising: a silicon substrate; a lower space part formed by etching at the silicon substrate; an insulating film formed on the silicon substrate surface to cover the lower space part which film applies compressive stress to the silicon substrate and undergoes bending transformation by the compressive stress of the silicon substrate which stress is expressed by the lower space part; and a shape memory alloy layer formed upon the insulation film so as to cover the lower space part which alloy layer is formed by independent sequential cumulative repetition of layering of each layer of respective composition element constituting the shape memory alloy and is bestowed shape memory property by heat treatment.

Ink jet printer head applying the microactuator using the shape memory alloy as explained above is to be electrified so that shape memory alloy under bending transformation condition is heated which alloy is then transformed into a flat condition which was mother shape.

Pressure room volume is decreased during shape memory alloy deformation process so that ink is ejected through nozzle to carry out printing.

Method of the present invention as described above is easy in control of composition constituting the shape memory alloy layer, particularly in 3-component system, so that shape memory property of shape memory alloy layer is enhanced.

And it makes effect that it is eminent in repetition uniformity of ingredient composition ratios compared to traditional methods in which simultaneous vapor deposition or sputtering of all formation components is carried out, because now each component element thickness and film growth sequence are independently controlled.

Figure 2:
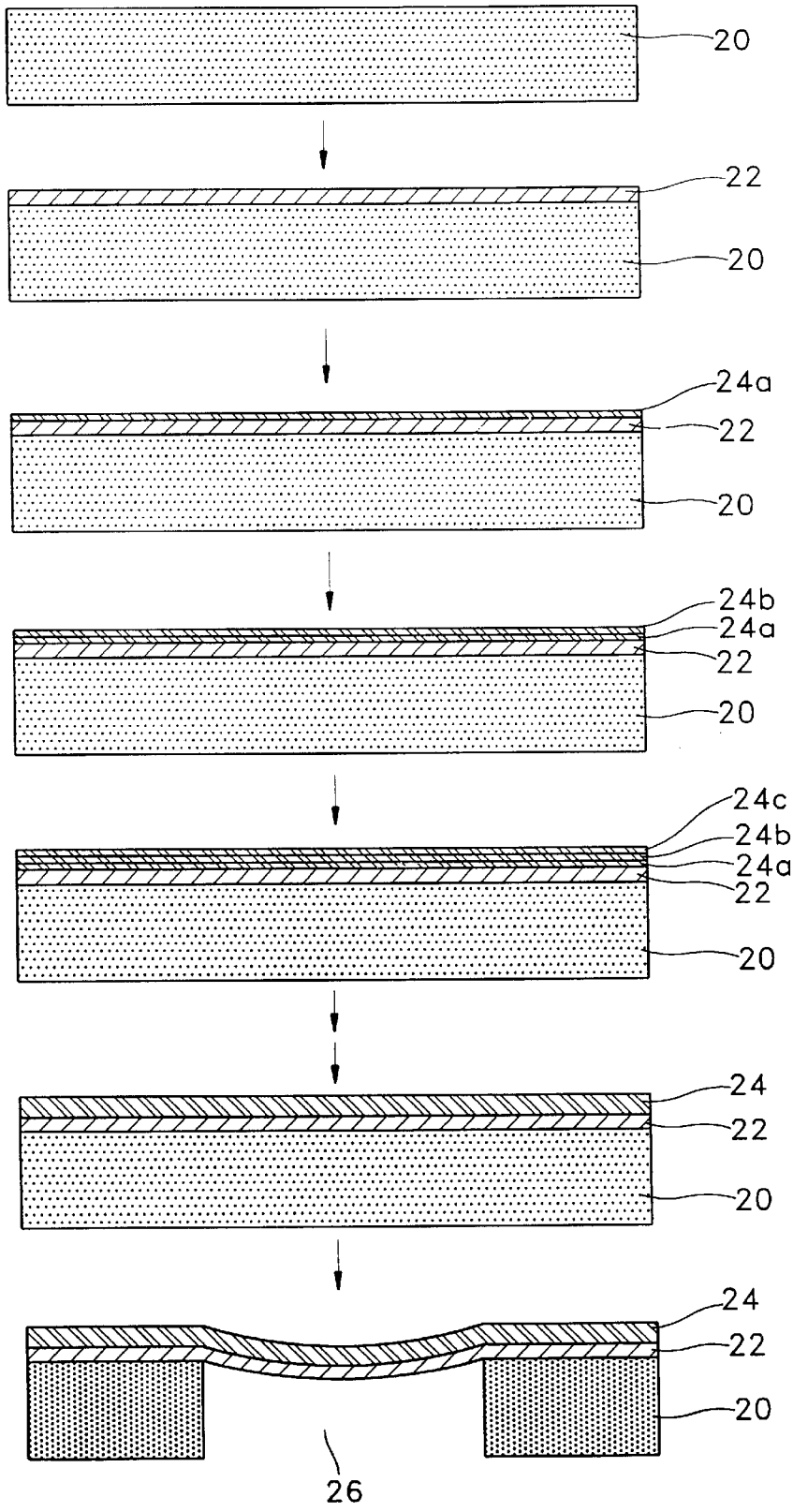
FIG. 2 is process flow sheet diagrammatically showing the manufacturing process of microactuator for ink jet printer head using a shape memory alloy.

FIG. 2 is an outline diagram of example of manufacturing process according to the present invention.

Insulating film 22 is formed upon silicon substrate 20 upon which film the composition element layers (including 24*a*, 24*b*, 24*c*) of shape memory alloy are formed.

Shape memory property is bestowed to the shape memory alloy layer 24 by repetition of thermally treating and cooling process of the component element layers (including 24*a*, 24*b*, 24*c*).

Lower space part 26 is formed by etching the silicon substrate 20 if shape memory alloy layer 24 acquired shape memory property.

Insulation film 22 and shape memory alloy layer 24 undergo a bending transformation by internal stress of silicon substrate when lower space part 26 has been formed as above.

What is claimed is:

1. A manufacturing method of a microactuator for an ink jet printer head using a shape memory alloy, the method comprising steps of:

providing a silicon substrate;

forming an insulating film on the surface of said silicon substrate;

forming a shape memory alloy layer by forming plural layers of respective component elements constituting said shape memory alloy on said insulation film;

bestowing a shape memory property by thermally treating said shape memory alloy layer;

and forming a lower space part by etching said silicon substrate.

2. The method in claim 1, further comprising the step of patterning said shape memory alloy where said shape memory property is bestowed.

3. The method in claim 2, further comprising the step of patterning said insulation film.

4. The method in claim 1, further comprising the step of forming an electrode upon said shape memory alloy where said shape memory property is bestowed.

5. The method in claim 1, wherein said insulation film comprises at least one of a silicon oxide film and a silicon nitride film.

6. The method in claim 5, wherein said insulation film is a film formed by one of heat treatment of said silicon substrate, chemical vapor deposition, or sputtering.

7. The method in claim 1, wherein said insulation film is formed 1–3 $\mu$m thick.

8. The method in claim 1, wherein a 2-component system of nickel and titanium is used for said shape memory alloy components.

9. The method in claim 1, wherein a 3-component system of nickel, titanium and copper is used for said shape memory alloy components.

10. The method in claim 1, wherein a 3-component system of nickel, titanium and hafnium is used for said shape memory alloy components.

11. The method in claim 1, wherein each component element layer constructing said shape memory alloy is formed below 1,000 Å thick.

12. The method in claim 11, wherein each component element layer constituting said shape memory alloy is formed below 500 Å thick.

13. The method in claim 1, wherein method to form each component element layer is evaporation or sputtering.

14. The method in claim 1, wherein said shape memory alloy layer is formed 1–3 $\mu$m thick.

15. A microaactuator for an ink jet printer head using a shape memory alloy, said microactuator comprising:

a silicon substrate;

a lower space part formed by etching at said silicon substrate;

an insulating film formed on said silicon substrate surface to cover said lower space part which said film applies compressive stress to said silicon substrate and undergoes bending transformation by the compressive stress of said silicon substrate which stress is expressed by said lower space part;

and a shape memory alloy layer formed upon said insulation film so as to cover said lower space part which said alloy layer is formed by independent, sequential, cumulative repetition of: layering a respective composition element constituting said shape memory alloy, and imparting a shape memory property by at least one heat treatment.

16. The micoactuator in claim 15, further comprising an electrode upon said shape memory alloy layer.

17. The micoactuator in claim 15, wherein said insulation film is silicon oxide film, silicon nitride film or silicon oxide film/nitride film.

18. The micoactuator in claim 15, wherein said insulation film is 1–3 $\mu$m thick.

19. The micoactuator in claim 15, wherein said shape memory alloy layer is made of 2-component system of nickel and titanium.

20. The micoactuator in claim 15, wherein said shape memory alloy layer is made of 3-component system of nickel, titanium and copper.

21. The micoactuator in claim 15, wherein said shape memory alloy layer is made of 3-component system of nickel, titanium and hafnium.

22. The micoactuator in claim 15, wherein each component element layer constructing said shape memory alloy is formed below 1,000 Å thick.

23. The micoactuator in claim 22, wherein each component element layer constituting said shape memory alloy is formed below 500 Å thick.

24. The micoactuator in claim 15, wherein each component element layer is formed by evaporation or sputtering.

25. The micoactuator in claim 15, wherein said shape memory alloy layer 1–3 $\mu$m thick.

* * * * *